US007287608B2

(12) United States Patent
Mocivnik et al.

(10) Patent No.: US 7,287,608 B2
(45) Date of Patent: Oct. 30, 2007

(54) METHOD AND DEVICE FOR DRILLING A HOLE IN SOIL OR ROCK MATERIAL AND FOR FORMING AN ANCHORING

(75) Inventors: Josef Mocivnik, Fohnsdorf (AT); Renè Egger-Mocivnik, Judenburg (AT)

(73) Assignee: "ALWAG" Tunnelausbau Gesellschaft m.b.h., Pasching (AT)

( * ) Notice: Subject to any disclaimer, the term of this patent is extended or adjusted under 35 U.S.C. 154(b) by 0 days.

(21) Appl. No.: 11/523,655

(22) Filed: Sep. 20, 2006

(65) Prior Publication Data

US 2007/0012484 A1 Jan. 18, 2007

Related U.S. Application Data

(63) Continuation of application No. PCT/AT2005/000100, filed on Mar. 22, 2005.

(30) Foreign Application Priority Data

Mar. 23, 2004 (AT) ..... A 508/2004

(51) Int. Cl.
*E21B 17/10* (2006.01)
*E21D 20/00* (2006.01)

(52) U.S. Cl. ..... 175/230; 175/57; 175/98; 405/259.1

(58) Field of Classification Search ..... 405/259.1, 405/259.5, 239–240, 302.2; 175/97, 98
See application file for complete search history.

(56) References Cited

U.S. PATENT DOCUMENTS 3,436,923 A * 4/1969 Lagerstrom ..... 405/259.5
6,588,986 B1 7/2003 Sibilla ..... 405/259

FOREIGN PATENT DOCUMENTS

DE 1634237 7/1970
FR 2643096 8/1990

* cited by examiner

*Primary Examiner*—David Bagnell
*Assistant Examiner*—Giovanna M Collins
(74) *Attorney, Agent, or Firm*—Jacobson Holman PLLC

(57) ABSTRACT

A method and device for boring a hole in soil or rock material and for forming an anchoring are disclosed. A borehole is formed by inserting a drill bit, and tensioning elements coupled to the drill bit are introduced into the borehole. After completion, the boring rods are detached from the drill bit and removed. The boring rods are provided with a hollow space in its longitudinal direction to introduce a hardenable fluid into the borehole. Anchoring or fixing elements for anchoring on the borehole's inner wall are provided on the drill bit at the end opposite the drilling surface and/or on the tensioning elements. The tensioning elements are subjected to a turning or twisting whereby shortening their effective length for tensioning or centering so that a centering and an optionally temporary tensioning of the tensioning elements can be effected before the hardenable material completely hardens.

15 Claims, 3 Drawing Sheets

FIG. 3
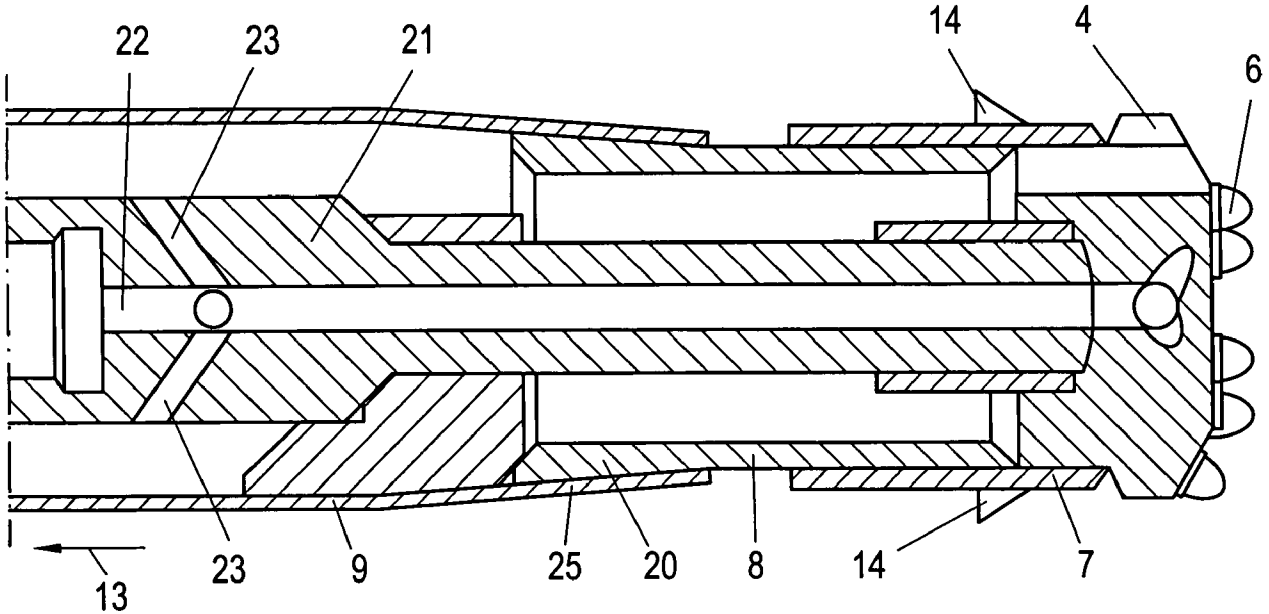
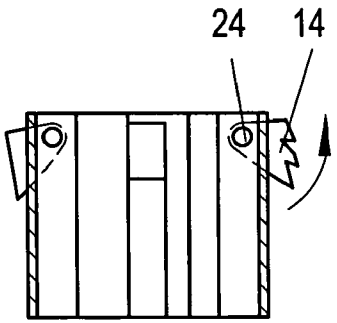
FIG. 4b
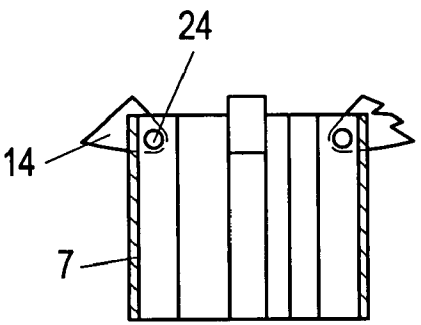
FIG. 4a

METHOD AND DEVICE FOR DRILLING A HOLE IN SOIL OR ROCK MATERIAL AND FOR FORMING AN ANCHORING

This is a continuation of PCT/AT05/000100 filed Mar. 22, 2005 and published in German.

FIELD OF THE INVENTION

The present invention relates to a method for drilling, in particular percussion drilling or rotary percussion drilling, a hole in soil or rock material and for forming an anchoring in said hole, wherein a borehole is formed by the introduction of a drill bit mounted on a drill rod assembly and tensioning elements coupled to the drill bit are introduced into the borehole during the drilling procedure, wherein the drill rod assembly is detached from the drill bit and removed from the borehole upon completion of the borehole, and wherein, during the removal of the drill rod assembly from the borehole, a curable fluid is introduced into the borehole through a hollow space provided in the drill rod assembly. The present invention further relates to a device for drilling, in particular percussion drilling or rotary percussion drilling, a hole in soil or rock material and for forming an anchoring, wherein a borehole is formed by the introduction of a drill bit and tensioning elements coupled to the drill bit are introduced into the borehole during the drilling procedure, wherein the drill rod assembly is detached from the drill bit and removed from the borehole upon completion of the borehole, wherein the drill rod assembly is formed with a hollow space extending substantially in the longitudinal direction of the drill rod assembly and provided for the introduction of a curable fluid into the borehole during the removal of the drill rod assembly from the borehole.

PRIOR ART

A method and device of the above-defined kind can, for instance, be taken from DE-A 1 634 237. In that known method for producing a tension rod in soil, tension elements or tension strings are introduced into a borehole with a drilling equipment comprising a drill bit and a drill rod assembly, and a curable fluid is introduced into the borehole through the hollow drill rod assembly once the borehole is completed. That known method and device, in particular, are aimed to introduce the tension elements into the borehole simultaneously during the drilling procedure, since, according to previously known methods, upon completion of a borehole and removal of the drilling device, tension elements were introduced into the borehole in a separate operating step, which was followed by the introduction of a curable fluid into the borehole. Those known configurations involved the drawback that the solidification of the curable fluid had to be awaited for the tensioning and centering of the tension elements, since the tension elements would have been immediately pulled out of, and removed from, the borehole, if the tension elements had been tensioned prior to the solidification of the curable fluid, since no anchorage or securement of the tension elements was provided prior to said solidification.

Departing from a method and device of the initially defined kind, the present invention aims to enable the centering and at least initial or temporary tensioning of the tension elements substantially immediately upon completion of the borehole and introduction of the curable fluid, without having to wait for the optionally long-lasting curing of the curable fluid in a borehole optionally having a large length.

SUMMARY OF THE INVENTION

To solve these objects, a method of the initially defined kind is essentially characterized in that the drill bit and/or the tension elements, in the end region facing the interior of the borehole, are secured to the borehole wall, and that tensioning and/or centering of the tension elements are effected by a partial distortion or twisting while shortening the effective lengths of the same. Due to the fact that, according to the invention, the drill bit and/or tension elements are secured to the borehole wall, particularly on the end facing the interior of the borehole, it is subsequently rendered feasible to subject the tension elements to a tensile stress from outside the borehole to thereby effect the centering of the tension elements, and/or the at least temporary tensioning of the same, even prior to the solidification of the curable fluid introduced into the interior of the borehole through the hollow drill rod assembly. Such temporary tensioning and/or centering of the tension elements ensures that the latter will properly extend over the total length within the borehole and be arranged in the borehole in a uniformly distributed manner, so that a uniform force introduction and distribution over the total cross section of the borehole will be safeguarded by the tension elements after the final solidification of the curable material and further tensioning of the tension elements. It is, thus, feasible according to the invention to prevent the tension elements from being substantially loosely arranged within the borehole and optionally forming angled regions or buckles, for instance during their introduction and the driving of the borehole, which, if the solidification of the curable material had to be awaited for the tensioning of the tension elements as in the prior art, would possibly result in a nonuniform force introduction and distribution over the cross section of the borehole. By the securement of the drill bit and/or tension elements connected therewith, and the centering or at least provisional tensioning of the tension elements while shortening their effective lengths, as is provided according to the invention, such a nonuniform arrangement of the tension elements will be prevented and it will, in particular, be reliably ensured that all of the tension elements will be arranged so as to be substantially uniformly distributed over the cross section of the borehole and in a properly tensioned and linearly extending manner in order to enable the introduction and absorption of accordingly high forces after the solidification of the curable material.

According to a preferred embodiment, it is proposed that said tensioning and/or centering of the tension elements are effected after the removal of the drill rod assembly and introduction of the curable fluid such that no influence by the drill rod assembly arranged substantially in the center of the borehole and through which the curable fluid is introduced into the interior of the borehole, will have to be feared, particularly during the distortion or twisting for the centering and tensioning of the tension elements.

For the introduction of large forces, which are provided in a manner uniformly distributed over the cross section of the borehole, it is contemplated according to a further preferred embodiment that, in a manner known per se, the tension elements are comprised of a plurality of wires or ropes substantially radially surrounding the drill rod assembly and mounted in a non-rotational manner relative to the borehole wall during the drilling of the borehole. By an appropriate number of wires or ropes arranged substantially radially around the drill rod assembly to form the tension elements, a uniform force introduction is subsequently ensured by the tension elements and the introduction of the tension elements can, moreover, be reliably effected during the drilling procedure. In doing so, it is provided according to the invention that despite a rotational movement to be optionally provided of the drill bit and, hence, the drill rod assembly, the tension elements are mounted in a non-rotational manner relative to the borehole wall in order to avoid any distortion or twist of the tension elements about the borehole axis defined by the drill rod assembly during the drilling procedure while, at the same time, shortening the effective lengths of the tension elements.

For the proper mounting or accommodation of the tension elements particularly during the drilling procedure, it is provided according to a further preferred embodiment that the tension elements are secured to a sleeve-shaped element arranged on the drill bit end facing away from the working face of the drill bit.

In order to ensure a structurally simple and reliable coupling for the introduction of the tension elements during the drilling procedure at an excavation movement of the drill bit, it is provided according to a further preferred embodiment that the sleeve-shaped element is secured to the drill bit end facing away from the working face.

As already pointed out above, the invention provides securement to the drill bit and/or tension elements, particularly on the end facing the interior of the borehole, for the subsequent centering and the subsequent, at least temporary tensioning of the tension elements. Such a secured fixation, particularly in the end region facing the interior of the borehole, can be assisted in that the sleeve-shaped element is expanded at least over a partial region of its periphery and/or longitudinal extension during said tensioning and/or centering of the tension elements, as in correspondence with a further preferred embodiment of the method according to the invention. Departing from a first, provisional and separate securement against an extraction from the borehole by tensioning the tension elements, the sleeve-shaped element can, thus, be expanded in the direction of an extraction movement from the borehole such that elevated forces will be created against an extraction from the borehole by an expansion of the sleeve-shaped element and, resulting therefrom, an abutment on the borehole inner wall.

As already indicated above, additional tensioning of the tension elements is feasible after the solidification of the curable fluid, wherein, in this respect, it is proposed according to a further preferred embodiment that further tensioning of the tension elements by a further distortion or twist is effected after the filling of the borehole with a curable fluid and, in a manner known per se, solidification of the same.

To solve the objects mentioned in the beginning, a device of the above-identified type is, moreover, essentially characterized in that anchoring or fixing elements for anchoring to the borehole inner wall are provided on the drill bit, on its end facing away from the working face, and/or on the tension elements, and that the tension elements, for tensioning or centering, are capable of being subjected to a distortion or twist while shortening their effective lengths, on their ends projecting out of the borehole. It is, thus, feasible to reliably secure the drill bit and/or the tension elements, particularly on their ends facing the borehole interior, so as to enable the subsequent centering and/or at least temporary or provisional tensioning of the tension elements prior to the solidification of the curable material. Such shortening of the effective lengths of the tension elements in a particularly simple manner can be realized by a distortion or twist of the same so as to provide a proper distribution of the tension elements over the cross section of the borehole and ensure the uniform introduction and absorption of force.

For a uniform distribution of the forces to be introduced or absorbed, it is, moreover, proposed in a preferred manner that the tension elements, in a manner known per se, are comprised of a plurality of wires or ropes substantially radially surrounding the drill rod assembly and mounted on the drill bit in a non-rotational manner relative to the borehole wall during the formation of the borehole. By mounting the tension elements on the drill bit in a non-rotational manner relative to the borehole wall during their introduction, a reliable introduction will, moreover, be ensured.

For the reliable entrainment of the tension elements during the drilling procedure, it is provided according to a further preferred embodiment that, on the drill bit end facing away from the working face, a sleeve-shaped element is mounted on the drill bit or an, impact shoe cooperating therewith, with the tension elements being fixed to the sleeve-shaped element.

To support the securement or anchorage of the drill bit and/or tension elements for said centering or at least temporary tensioning, it is provided according to a further preferred embodiment that the sleeve-shaped element comprises a longitudinally extending slit and is capable of being expanded during said tensioning and/or centering of the tension elements.

A structurally simple and reliable fixation of the tension elements via the sleeve-shaped element and a reliable expansion during centering or tensioning will, moreover, be ensured in that the sleeve-shaped element is secured to the drill bit, or an impact shoe cooperating therewith, in a fixation region extending from the working face of the drill bit and having an increasing outer diameter, as in correspondence with a further preferred embodiment of the device according to the invention.

For the reliable and proper securement or fixation of the device, particularly on the end facing the interior of the borehole, it is provided according to a further preferred embodiment that the fixing elements are comprised of at least one hook or the like, in particular foldout hook, projecting from the outer periphery of the drill bit and/or sleeve-shaped element. Such hooks will penetrate into the surrounding rock or soil material and, hence, provide securement during the tensioning of the jacket tube. By arranging the pivot axes of the hooks, in particular, on hook ends facing the borehole interior, the substantially automatic emergence of the hooks will be caused by a retraction of the device or tension elements during tensioning such that no additional and optionally expensive mechanisms for bringing out or extracting the fixing or anchoring elements will be required.

BRIEF DESCRIPTION OF THE DRAWINGS

In the following, the invention will be explained in more detail by way of exemplary embodiments schematically illustrated in the accompanying drawing. Therein:

FIG. 3, on an enlarged scale, illustrates a section through the region of the drill bit as well as an impact shoe following thereupon, and a sleeve-shaped element for introducing and fixing tension elements; and FIGS. 4*a*-4*b*, on an enlarged scale, depict schematic illustrations of fixing elements used to secure the device and/or tension elements, in particular, on the end facing the interior of the borehole, FIG. 4*a* illustrating the state of completely extracted or expanded fixing elements and FIG. 4*b* illustrating an intermediate position of the fixing elements.

DESCRIPTION OF PREFERRED EMBODIMENTS

Figure 1A:
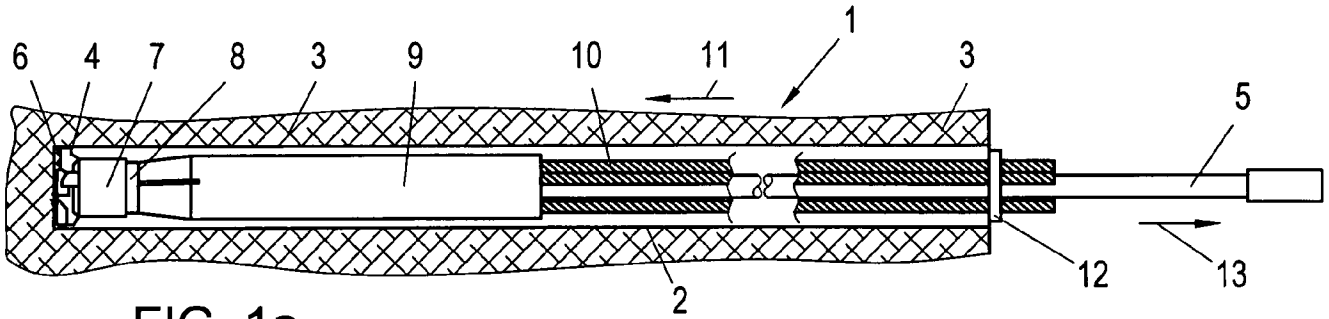
FIGS. 1*a*-1*c* depict schematic side views of different steps in the realization of the method according to the invention using the device according to the invention, FIG. 1*a* showing the step of the drilling procedure according to the invention, FIG. 1*b* showing the step of securing the drill bit and/or tension elements to the borehole wall with the drill rod assembly already removed, and FIG. 1*c* showing the step of tensioning and/or centering the tension elements.
Figure 1B:
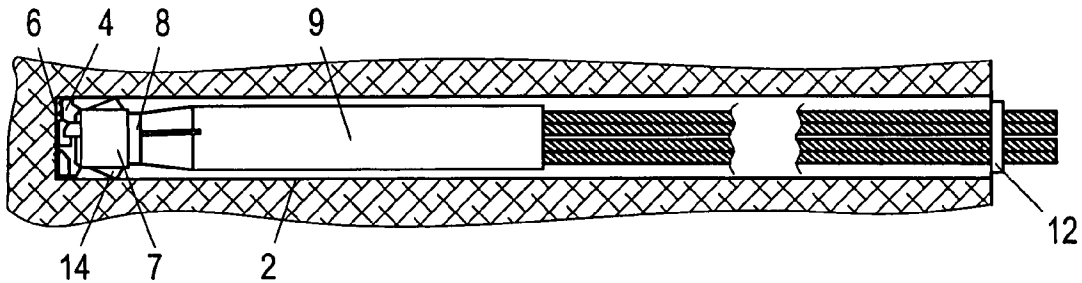
Figure 1C:
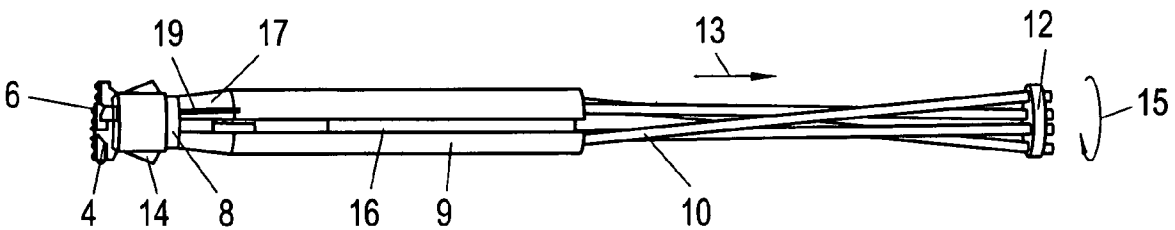

FIGS. 1*a*-1*c* depict different steps in the production of a borehole using a device generally denoted by 1, for the drilling, in particular percussion drilling or rotary percussion drilling, of a hole 2 in soil or rock material schematically indicated by 3.

In the illustrations according to FIGS. 1*a*-1*c* and 2, a schematically indicated drill bit 4 is provided, which is set in a percussive and/or rotary percussive movement by a drive not illustrated in detail, via a drill rod assembly denoted by 5 in FIG. 1*a*, in order to form a borehole 2 with excavation elements 6 indicated on the drill bit 4.

An impact shoe 8, which is more clearly apparent especially from FIG. 3, follows upon the drill bit 4 via an intermediate element 7, which will be explained in more detail below and, in particular, with reference to FIGS. 3 and 4*a*-4*c*, wherein a sleeve-shaped element 9 is mounted on the impact shoe 8 to secure and entrain, during the drilling procedure, tension elements 10 formed, in particular, by ropes or wires.

Figure 2:
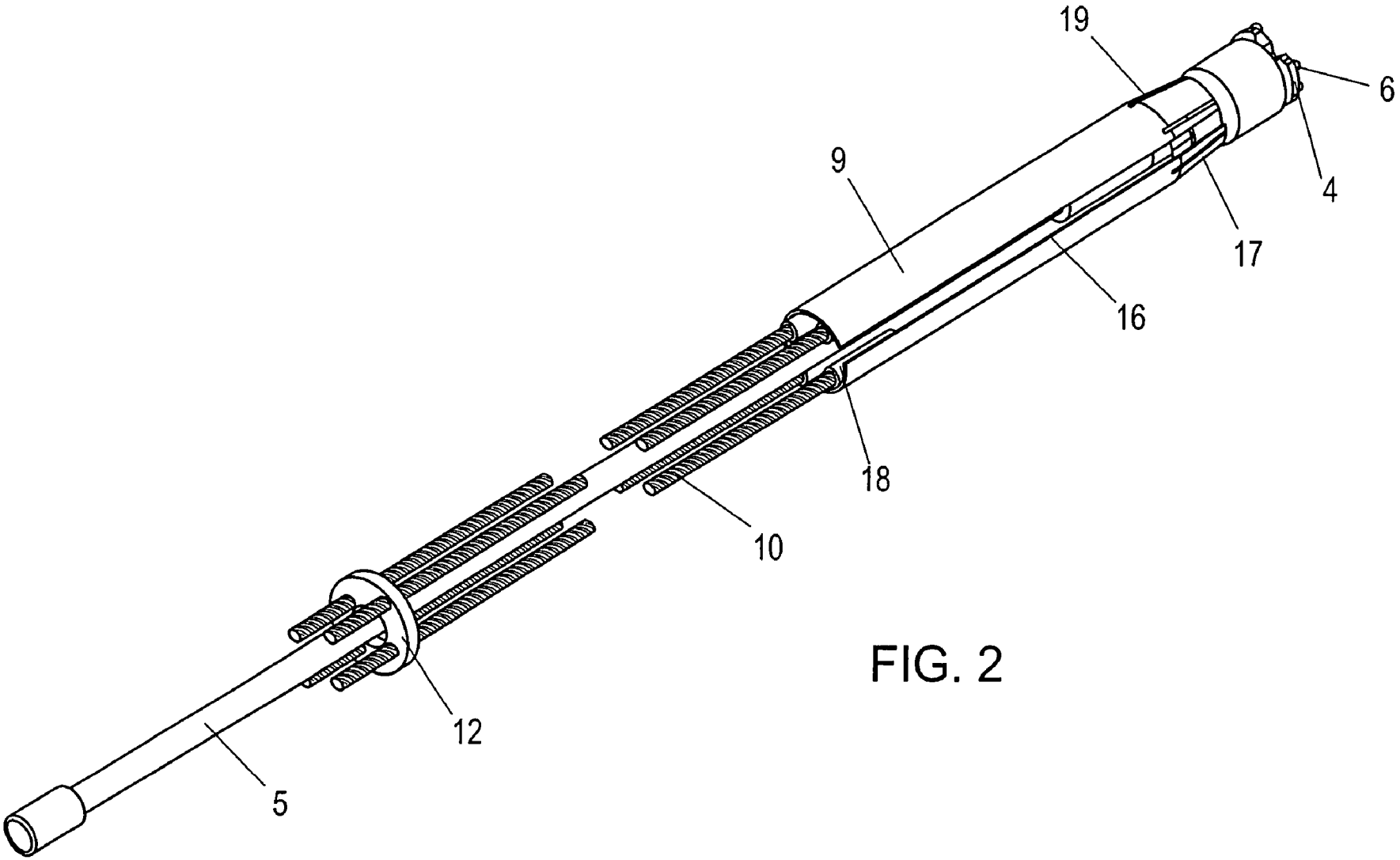
FIG. 2 is a schematic, perspective illustration of a device according to the invention for carrying out the method of the invention.

As indicated in FIG. 1*a*, the tension elements 10 are introduced into the borehole in the sense of arrow 11 in a non-rotational manner relative to the borehole wall 2, wherein, in addition to being fixed in the region of the sleeve-shaped element 9, as is even more clearly apparent from FIG. 2, a bearing disc or bearing ring 12 is provided, particularly on the end projecting out of the soil or rock material 3, to mount the tension elements 10 formed by wires or ropes.

Once the bore 2 is completed, the drill rod assembly 5 is removed from the borehole in the sense of arrow 13 oppositely to the driving or drilling direction 11, with a curable fluid being introduced into the completed borehole 2 during the removal of the drill rod assembly 5.

After having removed the drill rod assembly 5 under the simultaneous introduction of the curable fluid into the interior of the borehole 2, which state is represented in FIG. 1*b*, fixing elements or anchoring elements 14 are brought into abutment against the borehole wall 2 from the intermediate element 7, as will be explained in more detail with reference to FIGS. 4*a*-4*b*. After having secured the drill bit 4 and the sleeve-shaped element 9 with the interposition of the anchoring elements 14 of the intermediate element 7, a rotation of the bearing ring or bearing disc 12 in the sense of arrow 15 in FIG. 1*c* is preformed to cause a twist of the tension elements 10 while reducing their effective lengths as well as centering and at least provisionally tensioning the tension elements 10 within the borehole 2. At this time, the curable fluid introduced into the borehole 2 has not yet completely solidified such that the desired centering or at least provisional tensioning of the tension elements 10 can be reliably effected. In doing so, the anchoring elements 14 act against the removal of the complete device 1 from the borehole 2 during the centering and tensioning procedure represented in FIG. 1*c*.

Moreover, the sleeve-shaped element 9 is designed to include a longitudinally extending slit 16, wherein the sleeve-shaped element 9 is designed to conically taper, particularly on its end 17 facing the borehole interior, so as to abut on a respective counter-surface on the impact shoe 8, as is more clearly illustrated in FIG. 3. When tensioning or turning or twisting the tension elements 10, the sleeve-shaped element 9 is slightly powered in the sense of an extraction 13, and an expansion of the outer periphery of the sleeve-shaped element 9 by the provision of the longitudinal slit 16 is feasible such that the sleeve-shaped element 9 is moved into abutment on the borehole inner wall, which is not illustrated in FIG. 1*c* for the sake of clarity, whereby the anchoring effect of the fixing elements 14 against an extraction in the sense of arrow 13 is supported.

As soon as the curable material has solidified, further tensioning of the tension elements 10 in the region of the bearing ring or bearing disc 12 can be effected.

From FIG. 2, it is apparent that the tension elements 10 are secured in appropriate sockets 18 provided on the end of the sleeve-shaped element 9 facing away from the borehole interior. Furthermore, the longitudinally extending slit 16 is again shown in FIG. 2, wherein additional slits 19 are indicated in the end region facing the borehole interior to enable an appropriate expansion.

From the enlarged illustration according to FIG. 3, it is apparent that the drill bit 4 is followed by an impact shoe 8, which, in a manner similar to the conically tapering partial region 25 of the sleeve-shaped element 9, is provided with a conically widening partial region 20 on its end facing away from the borehole interior such that, during the tensioning of the tension elements, which are not illustrated in detail in FIG. 3, an expansion of the partial region 25 of the sleeve-shaped element 9 facing the borehole interior and subsequently, via the longitudinal slit 16, also of the consecutively arranged cylindrical partial region of the sleeve-shaped element 9 will be effected by a movement of the sleeve-shaped element 9, again in the extraction direction denoted by 13.

FIG. 3, furthermore, indicates that the drill rod assembly, whose foremost part is denoted by 21, not only comprises a central hollow space or channel 22, for instance, for the introduction of a coolant into the region of the drill bit or drill head 4 during the drilling procedure, but that feed openings 23 are also provided to enable, during the removal of the drill rod assembly 5 upon completion of the borehole as indicated in FIG. 1*a*, the simultaneous introduction of a curable fluid into the interior of the borehole 2 via the central supply opening or central channel 22.

FIGS. 4*a*-4*b* schematically depict the fixing elements 14 used to open or anchor the drill bit 4 and/or the tension elements 10 and the sleeve-shaped element 9, particularly on the side facing the borehole interior, wherein it is apparent that the fixing elements 14 are formed by hook-shaped elements which are pivotable about an axis 24 and, during the tensioning or centering of the tension elements 10 in the sense of arrow 13 of FIG. 1*c*, are brought into engagement with the borehole inner wall schematically indicated by 2, whereby, departing from the intermediate state represented in FIG. 4*b*, the state illustrated in FIG. 4*a* is reached to provide reliable anchoring. The fixing elements 14, which may be arranged in an accordingly uniformly distributed manner about the periphery of the intermediate element denoted by 7 substantially immediately consecutively to the drill bit 4, thus provide safe anchoring so as to prevent the anchor-forming device 1 from being extracted from the bore 2 during the subsequent tensioning and/or centering of the tension elements 10 in the sense of arrow 13 in FIG. 1*c* and enable the introduction and absorption of large tensile forces via the tension elements 10 using the device 1 or anchor as well as the curable fluid contained therein, after the final solidification of the latter.

The invention claimed is:

1. A method for drilling a hole in soil or rock material and for forming an anchoring in said hole, comprising the steps of forming a borehole by the introduction of a drill bit mounted on a drill rod assembly;

introducing tensioning elements coupled to the drill bit into the borehole during the drilling procedure;

detaching the drill rod assembly from the drill bit and removing the drill rod from the borehole upon completion of the borehole;

during the removal of the drill rod assembly from the borehole, introducing a curable fluid into the borehole through a hollow space provided in the drill rod assembly;

securing the drill bit and the tension elements to the borehole wall in the end region facing the interior of the borehole by an anchoring or fixing element on the drill bit; and tensioning and/or centering the tension elements by a partial distortion or twisting while shortening the effective lengths of the tension elements substantially immediately upon completion of the borehole and introduction of the curable fluid without waiting for the curing of the curable fluid in the borehole.

2. The method according to claim 1, wherein the anchoring or fixing element comprises at least one hook projecting from an outer periphery of a jacket tube that embraces the drill bit.

3. The method according to claim 2, wherein the hook is a foldout hook.

4. The method according to claim 1, wherein the tension elements are comprised of a plurality of wires or ropes substantially radially surrounding the drill rod assembly and mounted in a non-rotational manner relative to the borehole wall during the drilling of the borehole.

5. The method according to claim 1, wherein the tension elements are secured to a first end of sleeve-shaped element facing away from a working face of the drill bit that faces a bottom of the borehole; and wherein a second end of the sleeve-shaped element is mounted to an impart shoe that contacts the drill bit.

6. The method according to claim 5, wherein the sleeve-shaped element is expanded at least over a partial region of its periphery and/or longitudinal extension during said tensioning and/or centering of the tension elements.

7. The method according to claim 1, wherein further tensioning of the tension elements by a further distortion or twist is effected after the filling of the borehole with a curable fluid and solidification of the same.

8. A device for drilling a hole in soil or rock material and for forming an anchoring, comprising:

drill bit;

a drill rod assembly mounted on the drill bit;

tensioning elements in connection with the drill bit through one or more connecting members; and anchoring or fixing elements provided on the drill bit;

wherein a borehole is formed by the introduction of the drill bit and the tensioning elements coupled to the drill bit are introduced into the borehole during the drilling procedure, wherein the drill rod assembly is detached from the drill bit and removed from the borehole upon completion of the borehole, wherein the drill rod assembly is formed with a hollow space extending substantially in the longitudinal direction of the drill rod assembly and provided for the introduction of a curable fluid into the borehole during the removal of the drill rod assembly from the borehole, wherein the anchoring or fixing elements for anchoring to the borehole inner wall are provided on the drill bit, on its end facing away from a working face that faces a bottom of the borehole, and that the tension elements, for tensioning or centering, are capable of being subjected to a distortion or twisting while shortening their effective lengths, on their ends projecting out of the borehole.

9. The device according to claim 8, wherein the tension elements are comprised of a plurality of wires or ropes substantially radially surrounding the drill rod assembly and mounted on the drill bit in a non-rotational manner relative to the borehole wall during the formation of the borehole.

10. The device according to claim 8, wherein, on the drill bit end facing away from the working face, a sleeve-shaped element is mounted on an impact shoe that cooperates with the drill bit, with the tension elements being fixed to the sleeve-shaped element.

11. The device according to claim 10, wherein the sleeve-shaped element comprises a longitudinally extending slit and is capable of being expanded during said tensioning and/or centering of the tension elements.

12. The device according to claim 10, wherein the sleeve-shaped element is secured to an impact shoe that cooperates with the drill bit, in a fixation region extending from the working face of the drill bit and having an increasing outer diameter.

13. The device according to claim 8, wherein the anchoring or fixing elements comprise at least one hook projecting from an outer periphery of a jacket tube that embraces the drill bit.

14. The device according to claim 13, wherein the hook is a foldout hook.

15. The device according to claim 14, wherein the foldout hook pivotable about an axis.

* * * * *